US009353472B2

(12) United States Patent
Leibman et al.

(10) Patent No.: US 9,353,472 B2
(45) Date of Patent: May 31, 2016

(54) PEDESTAL IN DISPENSER CUPS OF A WASHING MACHINE

(71) Applicant: General Electric Company, Schenectady, NY (US)

(72) Inventors: Alexander Boris Leibman, Louisville, KY (US); Jerrod Aaron Kappler, Louisville, KY (US); Taranjeet Singh, Andhra Pradesh (IN)

(73) Assignee: General Electric Company, Schenectady, NY (US)

( * ) Notice: Subject to any disclaimer, the term of this patent is extended or adjusted under 35 U.S.C. 154(b) by 402 days.

(21) Appl. No.: 13/735,231

(22) Filed: Jan. 7, 2013

(65) Prior Publication Data

US 2014/0190216 A1 Jul. 10, 2014

(51) Int. Cl.
*D06F 39/02* (2006.01)
*D06F 39/12* (2006.01)

(52) U.S. Cl.
CPC ..... *D06F 39/02* (2013.01); *D06F 39/022* (2013.01); *D06F 39/12* (2013.01)

(58) Field of Classification Search
CPC ..... D06F 39/02; D06F 39/022; D06F 39/028
See application file for complete search history.

(56) References Cited

U.S. PATENT DOCUMENTS

| | | | | |
|---|---|---|---|---|
| 3,086,379 | A * | 4/1963 | Plante | 68/12.13 |
| 3,696,970 | A * | 10/1972 | Bunnell et al. | 222/145.1 |
| 4,160,367 | A * | 7/1979 | Vona, Jr. | 68/17 R |
| 7,900,486 | B2 * | 3/2011 | Richman et al. | 68/17 R |
| 8,074,476 | B2 * | 12/2011 | Quandt | 68/17 R |
| 2008/0256723 | A1 * | 10/2008 | Kim et al. | 8/159 |
| 2009/0095031 | A1 * | 4/2009 | Favaro et al. | 68/17 R |
| 2009/0100880 | A1 * | 4/2009 | Hill | 68/17 R |
| 2009/0158782 | A1 * | 6/2009 | Hill | 68/12.18 |
| 2010/0000264 | A1 * | 1/2010 | Luckman et al. | 68/4 |
| 2010/0000578 | A1 * | 1/2010 | Hendrickson et al. | 134/34 |
| 2011/0120196 | A1 * | 5/2011 | Kim | 68/17 R |
| 2012/0204606 | A1 * | 8/2012 | Buso et al. | 68/17 R |

* cited by examiner

*Primary Examiner* — Joseph L Perrin
(74) *Attorney, Agent, or Firm* — Dority & Manning, P.A.

(57) ABSTRACT

A fluid additive dispenser for a washing machine appliance is provided. The dispenser includes a platform have a receiving surface. The receiving surface is elevated relative to a bottom of the dispenser and is positioned in view of an opening in the top of the dispenser. As fluid additives are drained or siphoned from the dispenser and off of the platform, the receiving surface will become visible through the opening even as some residual fluid additives may remain in the dispenser. The user is thereby provided with a more desirable appearance inside the dispenser with regard to e.g., residues or remains of fluid additives that would otherwise be visible.

19 Claims, 4 Drawing Sheets

PEDESTAL IN DISPENSER CUPS OF A WASHING MACHINE

FIELD OF THE INVENTION

The subject matter of the present disclosure relates generally to fluid additive dispensers for appliances, e.g., washing machine appliances.

BACKGROUND OF THE INVENTION

Washing machine appliances generally form wash and rinse fluids to clean clothing articles disposed within a wash basket of the appliance. The wash fluid can include, for example, water and various fluid additives, e.g., detergent, fabric softener, and/or bleach. The fluid additives can be mixed with water within a wash tub of the appliance in order to form the wash fluid. Various fluid additives may also be added to water to form the rinse fluid.

To introduce one or more fluid additives into the wash tub, a user can manually add the fluid additive to the wash tub and/or the wash basket. For example, after starting the appliance, the user can pour detergent directly into the wash basket. Conversely, certain washing machine appliances include features for receiving fluid additives and dispensing the fluid additives during operation of the appliance. For example, a tray may be mounted to or directly beneath top panel of a vertical axis washing machine appliance that can receive a fluid additive and direct the fluid additive into a wash tub of the appliance. Similarly, a horizontal axis washing machine appliance can include a drawer with a container mounted therein that receives a fluid additive and directs the fluid additive into a wash tub of the appliance.

With a tray, for example, fluid additive introduced into the tray by the user drains from the tray through a channel or other pathway to the wash chamber or wash bin. However, some fluid additives, such as fabric softener and laundry detergent, can have e.g., a relatively high viscosity, may not drain rapidly from the tray, and/or may a leave a residue that is visible to the consumers. This presence of residual fluid additive in the tray may provide an undesirable appearance for certain consumers and/or cause concerns regarding whether the fluid additive was properly dispensed.

Accordingly, a washing machine appliance having a fluid additive dispenser would be useful. More particularly, a washing machine appliance having a fluid additive dispenser that can more readily drain fluid additives away from the portion of the dispenser that is visible to the consumer would be useful.

BRIEF DESCRIPTION OF THE INVENTION

The present invention provides a fluid additive dispenser for a washing machine appliance. More particularly, the present invention provides a fluid additive dispenser for a washing machine appliance that includes a platform having a receiving surface. The receiving surface is elevated relative to a bottom of the dispenser and is positioned in view of an opening formed in the top of the dispenser. As fluid additives are drained or siphoned from the dispenser and off of the platform, the receiving surface will become visible through the opening even as some residual fluid additives may remain in the dispenser. The user is thereby provided with a more desirable appearance inside the dispenser with regard to e.g., residual fluid additives that would otherwise be visible. Additional aspects and advantages of the invention will be set forth in part in the following description, or may be apparent from the description, or may be learned through practice of the invention.

In a first exemplary embodiment, the present invention provides a washing machine appliance. The appliance includes a cabinet and a wash chamber located within the cabinet that is configured for containing fluid during operation of the washing machine appliance. A wash basket is rotatably mounted within the wash chamber and is configured for receipt of articles for washing. A fluid additive dispenser is positioned near the wash chamber and is configured for feeding one or more fluid additives into the wash chamber. The fluid additive dispenser includes an upper portion and a lower portion joined with the upper portion to form a dispenser chamber for the receipt of one or more fluid additives. The lower portion includes a bottom surface having a platform that includes a receiving surface that is elevated relative to the bottom surface of the lower portion. An opening is formed in the upper portion whereby fluid may be introduced into the dispenser chamber. The opening is positioned directly over the platform.

In another exemplary embodiment, a fluid additive dispenser for a washing machine appliance is provided. The dispenser includes a container defining a dispenser chamber for the receipt of one or more fluid additives. The container has an opening along an upper portion of the container. A platform projects into the chamber from a bottom portion of the container. The platform is positioned directly below the opening in the upper portion.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
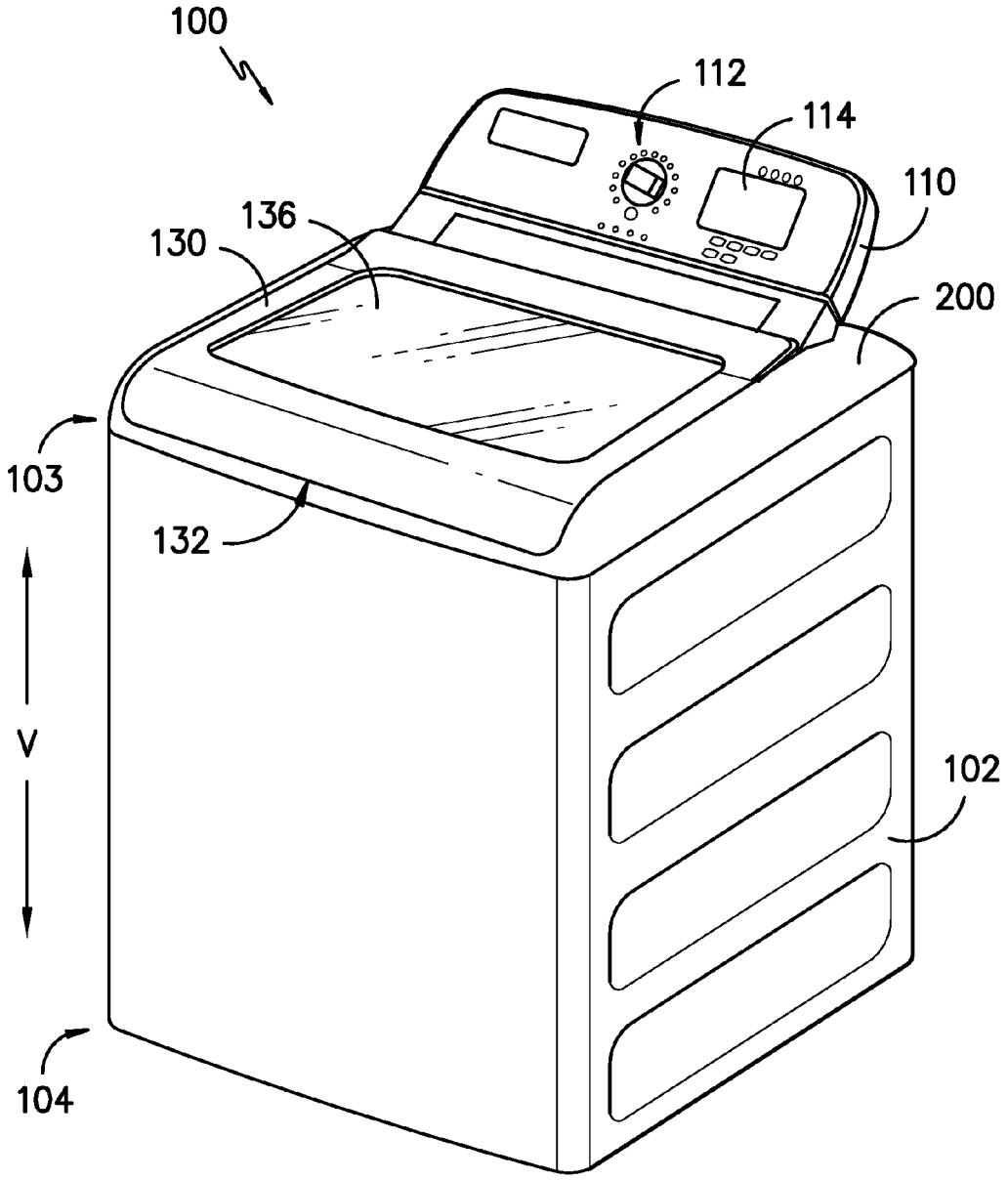
FIG. 1 illustrates an exemplary embodiment of a washing machine appliance of the present invention with a door shown in the closed position.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
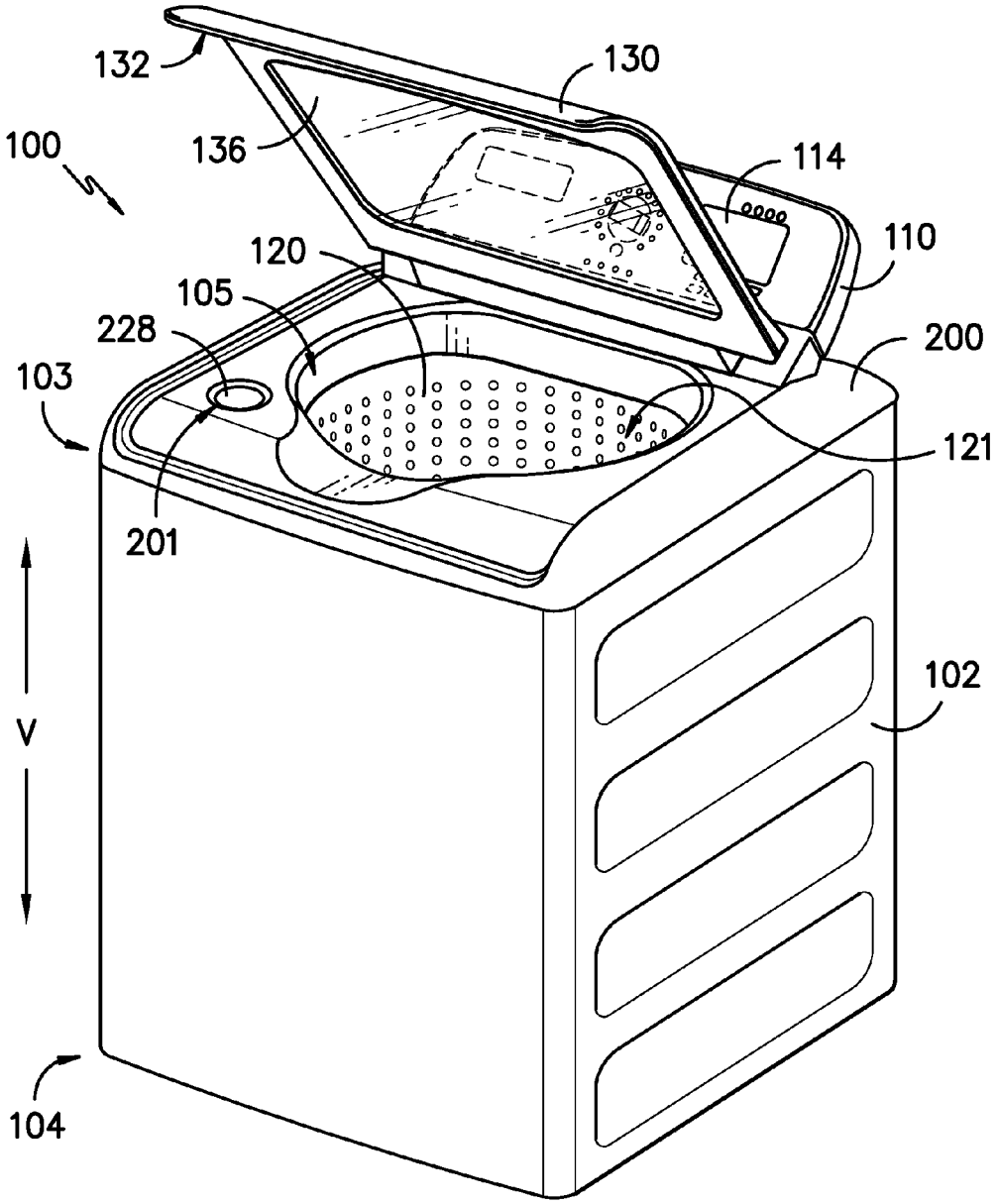
FIG. 2 illustrates the exemplary embodiment of a washing machine shown in FIG. 1 except with a door shown in an open position.

FIGS. 1 and 2 illustrate an exemplary embodiment of a vertical axis washing machine appliance 100. In FIG. 1, a lid or door 130 is shown in a closed position. In FIG. 2, door 130 is shown in an open position. While described in the context of a specific embodiment of vertical axis washing machine appliance 100, using the teachings disclosed herein it will be understood that vertical axis washing machine appliance 100 is provided by way of example only. Other washing machine appliances having different configurations, different appearances, and/or different features may also be utilized with the present subject matter as well, e.g., horizontal axis washing machines.

Washing machine appliance 100 has a cabinet 102 that extends between a top 103 and a bottom 104 along a vertical direction V. A wash basket 120 (FIG. 2) is rotatably mounted within cabinet 102. A motor (not shown) is in mechanical communication with wash basket 120 in order to selectively rotate wash basket 120 (e.g., during an agitation or a rinse cycle of washing machine appliance 100). Wash basket 120 is received within a wash bin or wash chamber 121 (FIG. 2) and is configured for receipt of articles for washing. The wash chamber 121 holds wash and rinse fluids for agitation in wash basket 120 within wash chamber 121. An agitator or impeller (not shown) extends into wash basket 120 and is also in mechanical communication with the motor. The impeller assists agitation of articles disposed within wash chamber 121 during operation of washing machine appliance 100.

Cabinet 102 of washing machine appliance 100 has a top panel 200. Top panel 200 defines an opening 105 (FIG. 2) that permits user access to wash chamber 121 of wash basket 120. Door 130 is rotatably mounted to top panel 200. However, alternatively, door 130 may be mounted to cabinet 102 or any outer suitable support. Door 130 selectively rotates between the closed position shown in FIG. 1 and the open position shown in FIG. 2. In the closed position, door 130 inhibits access to wash chamber 121. Conversely, in the open position, a user can access wash chamber 121. A window 136 in door 130 permits viewing of wash chamber 121 when door 130 is in the closed position, e.g., during operation of washing machine appliance 100. Door 130 also includes a handle 132 that, e.g., a user may pull and/or lift when opening and closing door 130.

Top panel 200 defines at least one opening 201 (FIG. 2) for receipt of one or more fluid additives, e.g., detergent, fabric softener, and/or bleach. While only one opening and fluid dispenser will be described herein, it will be understood the multiple openings and fluid dispensers may be used in alternative embodiments of the invention. Opening 201 permits fluid additives to pass through top panel 200 and through an opening 228 in a fluid additive dispenser 210 (FIG. 3) disposed below top panel 200 (along the vertical direction V) and positioned near wash chamber 121. Fluid additive dispenser 210 is described in greater detail below.

A control panel 110 with at least one input selector 112 (FIG. 1) extends from top panel 200. Control panel 110 and input selector 112 collectively forms a user interface input for operator selection of machine cycles and features. A display 114 of control panel 110 indicates selected features, operation mode, a countdown timer, and/or other items of interest to appliance users regarding operation.

Operation of washing machine appliance 100 is controlled by a controller or processing device (not shown) that is operatively coupled to control panel 110 for user manipulation to select washing machine cycles and features. In response to user manipulation of control panel 110, the controller operates the various components of washing machine appliance 100 to execute selected machine cycles and features.

In an illustrative embodiment, laundry items are loaded into wash chamber 121 through opening 105, and washing operation is initiated through operator manipulation of input selectors 112. A tub or wash basket 120 (shown in FIG. 3) is filled with water and detergent and/or other fluid additives from e.g., dispenser 210, to form wash and rinse fluids. One or more valves (not shown) can be controlled by washing machine appliance 100 to provide for filling wash basket 120 to the appropriate level for the amount of articles being washed and/or rinse. By way of example for a wash mode, once wash basket 120 is properly filled with fluid, the contents of wash chamber 121 can be agitated (e.g., with an impeller as discussed previously) for washing of laundry items in wash basket 120.

After the agitation phase of the wash cycle is completed, wash basket 120 can be drained. Laundry articles can then be rinsed by again adding fluid to wash basket 120 depending on the particulars of the cleaning cycle selected by a user. The impeller may again provide agitation within wash chamber 121. One or more spin cycles may also be used. In particular, a spin cycle may be applied after the wash cycle and/or after the rinse cycle in order to wring wash fluid from the articles being washed. During a spin cycle, wash basket 120 is rotated at relatively high speeds. After articles disposed in wash basket 120 are cleaned and/or washed, the user can remove the articles from wash basket 120, e.g., by reaching into wash chamber 121 through opening 105.

Figure 3:
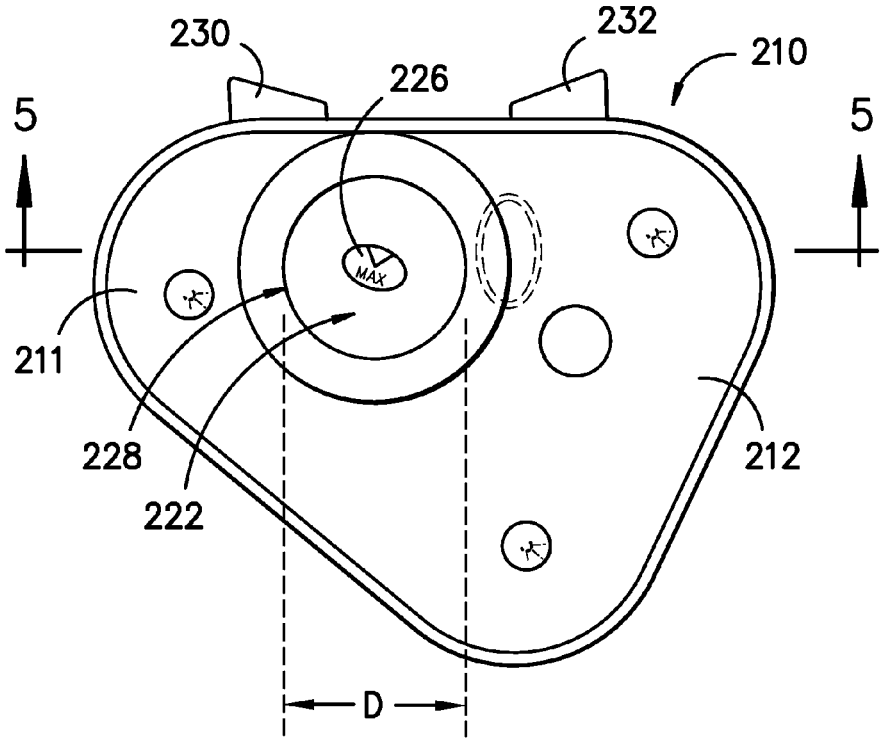
FIG. 3 is a top view of an exemplary embodiment of a fluid dispenser of the present invention with an upper portion or cover shown in place.
Figure 4:
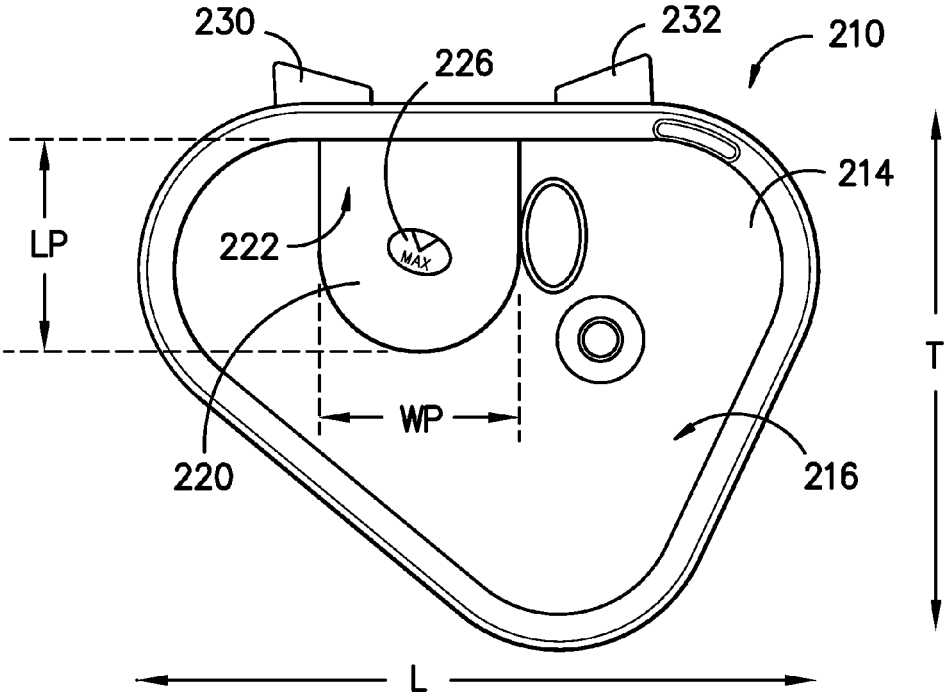
FIG. 4 is a top view of the exemplary embodiment of the fluid dispenser of FIG. 3 with an upper portion or cover removed to more clearly reveal details of the lower portion.
Figure 5:
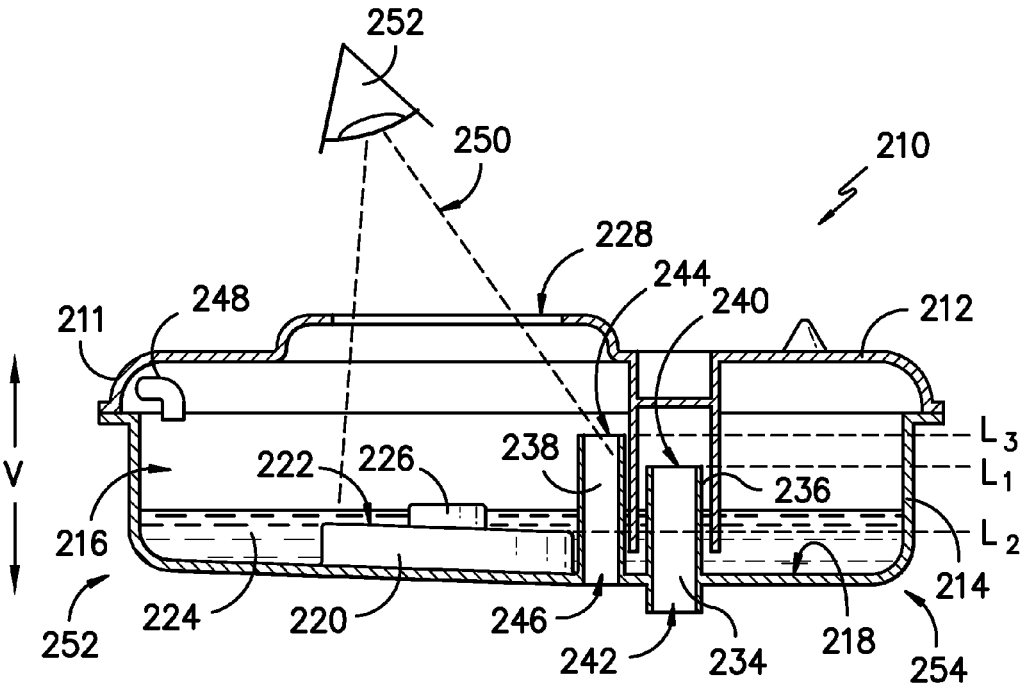
FIGS. 5 and 6 are cross-sectional views of the exemplary embodiment of FIG. 3.
Figure 6:
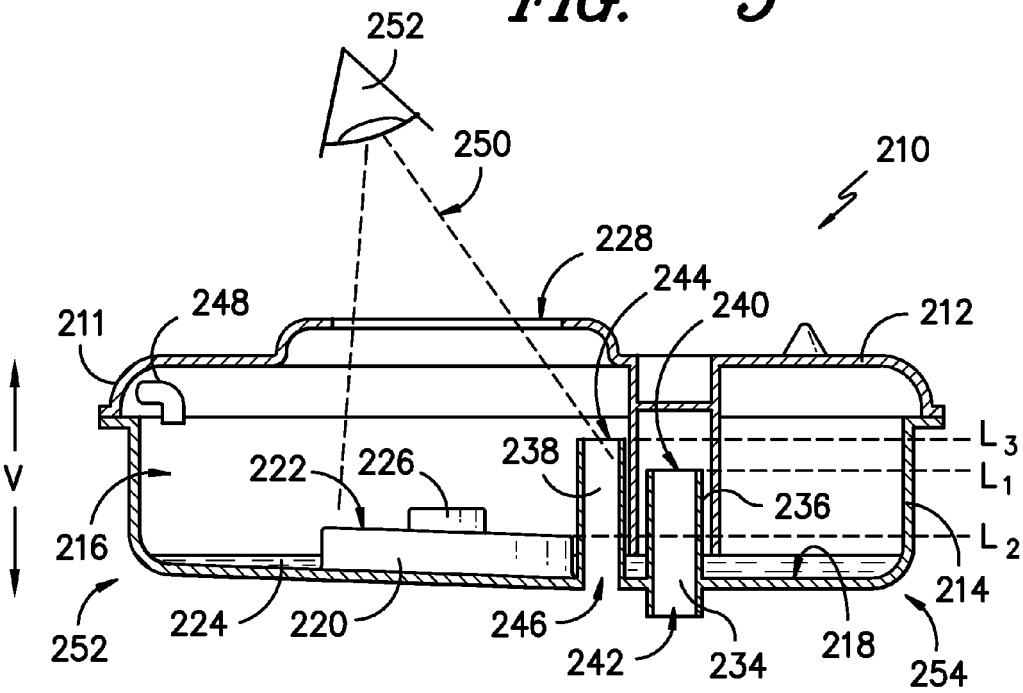

FIG. 3 is a top view of an exemplary embodiment of a fluid additive dispenser 210 formed from container 211. An upper portion 212 of container 211 is shown in place in FIG. 3. FIG. 4 is also a top view but with upper portion 212 of container 211 removed to show lower portion 214. By way of example, portions 212 and 214 can be plastic molded parts that are joined to create container 211 having a dispenser chamber 216 for the receipt of one or more fluid additives. Other constructions may be used as well. FIGS. 5 and 6 provide cross-sectional views of fluid additive dispenser 210 as will be further described below.

Lower portion 214 includes a bottom surface 218. A platform 220 extends from bottom surface 218 and defines a receiving surface 222 that is elevated by platform 220 relative to bottom surface 218. One or more fluid additives 224 placed into dispenser 210 by a user may be e.g., poured onto receiving surface 222 to partially fill dispenser chamber 216. A level indicator 226 extending from the receiving surface 222 denotes to the user the maximum fill level for dispenser 210. An opening 228 is formed in upper portion 212 of dispenser 210 whereby one or more fluid additives may be introduced into dispenser chamber 216. Tabs 230 and 232 assist with mounting dispenser 210 into appliance 100.

Dispenser 210 includes a siphon 234 that is formed by an open channel 236 that extends into dispensing chamber 216 and through the bottom surface 218 of lower portion 214. Channel 236 also extends vertically to a level $L_1$ that is higher than the level $L_2$ of receiving surface 222 but lower than the level $L_3$ of an overflow 238. Channel 236 is open between top end 240 and bottom end 242. Similarly, overflow 238 extends vertically into chamber 216 to level $L_3$ and is open between top end 244 and bottom end 246.

Accordingly, for this exemplary embodiment of dispenser 210, a user pours one or more fluid additives through opening 228 and into dispenser chamber 216. This causes the level of fluid additives 224 to rise and, as shown in FIG. 5, may reach a vertical level above $L_2$—the level of the receiving surface 222 of platform 220 as shown in FIG. 5. At the proper time during a wash or rinse cycle, a controller causes water to enter chamber 216 through a fill tube 248 (or other construction that may be provided) to raise the level of fluid. Eventually, the fluid level rises above the level $L_3$ at top end 240 of siphon 234, which creates a siphon effect to draw additive fluid 224 out of dispenser chamber 216 and into wash chamber 121 through bottom end 242. Any overflow of fluid above level $L_3$ at top end 244 of overflow 238 will be emptied out of chamber 216 through the bottom end 246 of overflow 238 where it will enter into wash chamber 121.

As the fluid level is siphoned out of dispenser chamber 216 through siphon 234, it falls below level $L_2$ and drains off of the receiving surface 222 of platform 220. As indicated by the angle of sight 250, the user's eye only sees receiving surface 222 from which the additive fluids 224 have drained and does not see any fluid residue that remains on bottom surface 218 in e.g., the sides 252 and/or 254 of dispenser 210. As such, unsightly residue and/or consumer concerns about whether enough fluid additive dispensed can be avoided or alleviated.

Alternatively, dispenser 210 can be provided with a channel, opening, chute, or the like (not shown) extending directly through the bottom surface 218 of lower portion 214. For such a construction, fluid placed into dispenser chamber 216 will drain directly into wash chamber 121 without use of a siphon. Again, the elevated receiving surface 222 of platform 220 provides a visible surface to the user from which fluid will eventually drain away.

Returning to FIGS. 3 and 4, the width W and length L of platform 220 relative to the width or diameter D of opening 228 can be adjusted to further ensure that the user primarily views receiving surface 222 through opening 228. For example, to obscure the user's ability to see bottom surface 218—particularly sides 252 and 254, the width WP and/or length LP of platform 220 can be increased relative to the diameter D of opening 228. Also, opening 228 is placed in a positioned that is substantially above receiving surface 222 of platform 220. Other constructions may be used as well to limit the user's vision to surface 222.

To enhance the effectiveness of receiving surface 222, it may be provided with a slope along the transverse direction T and/or lateral direction L as shown, for example, in FIGS. 5 and 6. Such slope can improve the ability of fluid 216 to drain away from surface 222. A slope for surface 222 other than what is shown in FIGS. 5 and 6 (i.e. in other directions) may be used as well. Also, for the exemplary embodiment shown, receiving surface 222 is elevated relative to bottom surface 218. For example, receiving surface 222 may be at least 2 mm above the bottom surface 218 of lower portion 214. By way of further example, receiving surface 222 may be in the range of about 2 mm to about 5 mm above the bottom surface 218 of lower portion 214.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance, comprising:

a cabinet;

a wash chamber located within said cabinet and configured for containing fluid during operation of the washing machine appliance;

a wash basket rotatably mounted within said wash chamber and configured for receipt of articles for washing;

a fluid additive dispenser positioned near said wash chamber and configured for feeding one or more fluid additives into said wash chamber, said fluid additive dispenser comprising:

an upper portion;

a lower portion joined with the upper portion to form a dispenser chamber for the receipt of one or more fluid additives, the lower portion including a bottom surface that defines an integral platform, the platform extending vertically from the bottom surface and defining a receiving surface that is substantially horizontal and elevated relative to the bottom surface of the lower portion, the platform further defining a substantially horizontal maximum fill level indicator that extends vertically from the receiving surface; and an opening formed in the upper portion whereby fluid additives may be introduced into the dispenser chamber, the opening positioned directly over the platform such that a user primarily views the receiving surface through the opening.

2. A washing machine appliance as in claim 1, wherein the receiving surface of the platform is larger than the opening in the upper portion.

3. A washing machine appliance as in claim 1, wherein the platform is positioned under the opening so that after a fluid in said dispenser drains off of the receiving surface of the platform the fluid is no longer visible below the opening.

4. A washing machine appliance as in claim 1, wherein the opening is circular in shape.

5. A washing machine appliance as in claim 4, wherein the opening has a diameter that is less than a width of the receiving surface of the platform.

6. A washing machine appliance as in claim 1, wherein the opening has a diameter that is less than a width of the receiving surface of the platform.

7. A washing machine appliance as in claim 1, wherein the receiving surface of the platform is sloped relative to the bottom surface of the lower portion.

8. A washing machine appliance as in claim 1, wherein the receiving surface of the platform is elevated at least 2 mm above the bottom surface of the lower portion.

9. A washing machine appliance as in claim 1, further comprising a siphon channel extending from the lower portion of the dispenser and configured for siphoning fluid from the dispenser.

10. A washing machine appliance as in claim 9, further comprising an overflow channel extending from the lower portion of the dispenser and having a height less than the siphon channel along a vertical direction of the appliance.

11. A fluid additive dispenser for a washing machine appliance, comprising:

a container defining a dispenser chamber for the receipt of one or more fluid additives, the container having an opening along an upper portion of the container whereby fluid additives may be introduced into the dispenser chamber and having a platform defined by and projecting vertically into the chamber from a bottom portion of the container, wherein the platform has an elevated and substantially horizontal receiving surface and is positioned directly below the opening in the upper portion such that a user primarily views the platform through the opening, and wherein the platform defines a substantially horizontal maximum fill level indicator that extends vertically from the platform.

12. A fluid additive dispenser as in claim 11, wherein said platform has a receiving surface that is larger than the opening.

13. A fluid additive dispenser as in claim 12, wherein the platform is positioned under the opening so that after a fluid in said dispenser drains off of the receiving surface of the platform the fluid is no longer visible below the opening.

14. A fluid additive dispenser as in claim 12, wherein the lower portion defines a bottom surface, and wherein the receiving surface of the platform is sloped relative to the bottom surface of the lower portion.

15. A fluid additive dispenser as in claim 14, wherein the receiving surface of the platform is elevated by an amount in the range of about 2 mm to about 5 mm above the bottom surface of the lower portion.

16. A fluid additive dispenser as in claim 11, wherein the opening in the upper portion is circular in shape.

17. A fluid additive dispenser as in claim 11, wherein the opening has a diameter that is less than a width and a length of a receiving surface of the platform.

18. A fluid additive dispenser as in claim as in claim 11, further comprising a siphon channel extending from the lower portion of the dispenser and configured for siphoning fluid from the dispenser.

19. A fluid additive dispenser as in claim 18, further comprising an overflow channel extending from the lower portion of the dispenser and having a height less than the siphon channel along a vertical direction of the appliance.

* * * * *